US005979202A

United States Patent [19]

Blakeley

[11] Patent Number: 5,979,202

[45] Date of Patent: Nov. 9, 1999

[54] METHOD AND APPARATUS FOR MAKING PIPE LINE STEEL GROOVED-END FITTINGS

[75] Inventor: James Blakeley, Thornhill, Canada

[73] Assignee: Blakeley Engineering Ltd., Thornhill, Canada

[21] Appl. No.: 08/864,640

[22] Filed: May 29, 1997

[51] Int. Cl.[6] ..... B21C 37/28

[52] U.S. Cl. ..... 72/68; 72/106; 29/890.149

[58] Field of Search ..... 29/890.149; 72/68, 72/105, 106, 369, 128

[56] References Cited

U.S. PATENT DOCUMENTS

| | | | |
|---|---|---|---|
| 373,777 | 11/1887 | Kirby | 72/106 |
| 2,137,864 | 11/1938 | Taylor | 29/890.149 |
| 2,406,838 | 9/1946 | Kepler . | |
| 2,461,323 | 2/1949 | Hille | 72/128 |
| 2,565,971 | 8/1951 | Kitlica . | |
| 2,675,049 | 4/1954 | Martin . | |
| 2,715,432 | 8/1955 | Wurzburger . | |
| 2,957,229 | 10/1960 | Beatty | 29/890.149 |
| 3,453,857 | 7/1969 | Reckard . | |
| 3,869,776 | 3/1975 | Moshnin et al. . | |
| 3,919,875 | 11/1975 | Maev et al. . | |
| 3,995,466 | 12/1976 | Kunsman | 72/105 |
| 4,759,206 | 7/1988 | Kaneko . | |
| 4,841,760 | 6/1989 | Ferguson . | |
| 5,094,096 | 3/1992 | Sheckells . | |
| 5,339,670 | 8/1994 | Granelli . | |

FOREIGN PATENT DOCUMENTS 0010057 4/1980 European Pat. Off. .

OTHER PUBLICATIONS

Operating Instructions And Data Sheet, ITT Grinnell/Gruvlok/model #2010 Operating Instructions, ITT Grinnel Gruvlok Data Sheet.

*Primary Examiner*—Lowell A. Larson
*Attorney, Agent, or Firm*—Burns, Doane, Swecker & Mathis, LLP

[57] ABSTRACT

A method for making a grooved-end pipe fitting from standard pipe includes the steps of bending length of pipe on a press mandrel to form a curved pipe segment with an oval cross section and further working the curved pipe segment in a die to produce tangent end portions. The die cavity is shaped with a central curved portion and tangent end portions. The inner and outer radii of curvature of the central curved portion are greater than the inner and outer radii of the curved pipe segment, and are greater than the corresponding radii of curvature of a conventional cast fitting. As a result, the curved pipe segment can be shaped to conform to the shape of the cavity without buckling or bowing of the inner radius wall of the pipe. The tangent ends of the die shaped pipe are grooved in a subsequent step.

8 Claims, 6 Drawing Sheets

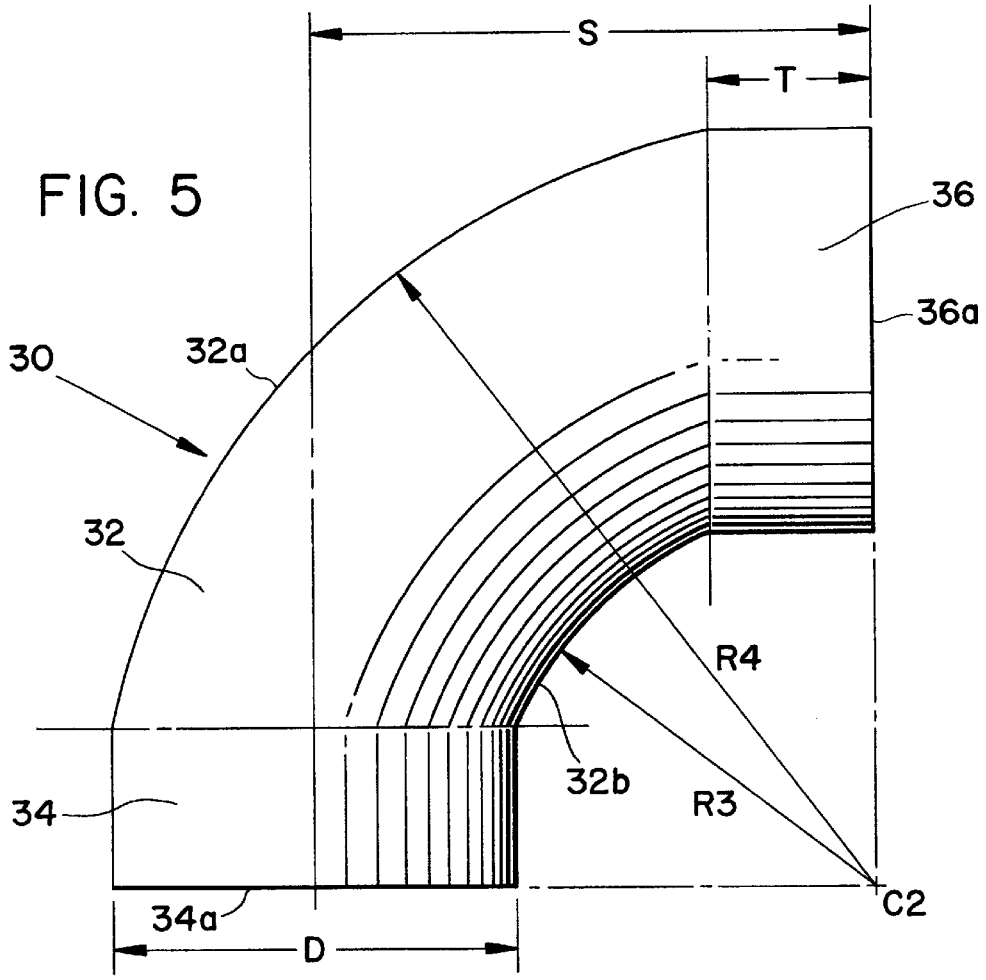
FIG. 5
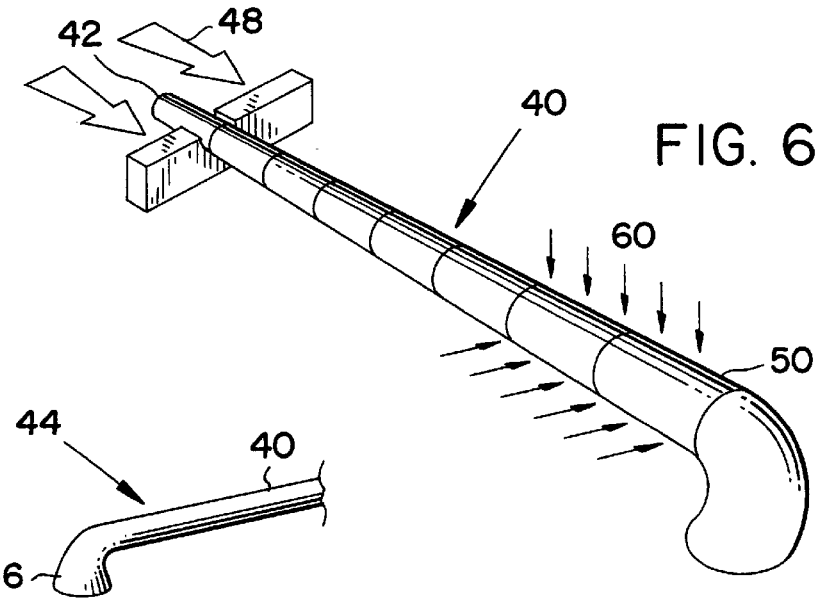
FIG. 6
FIG. 7

FIG. 10
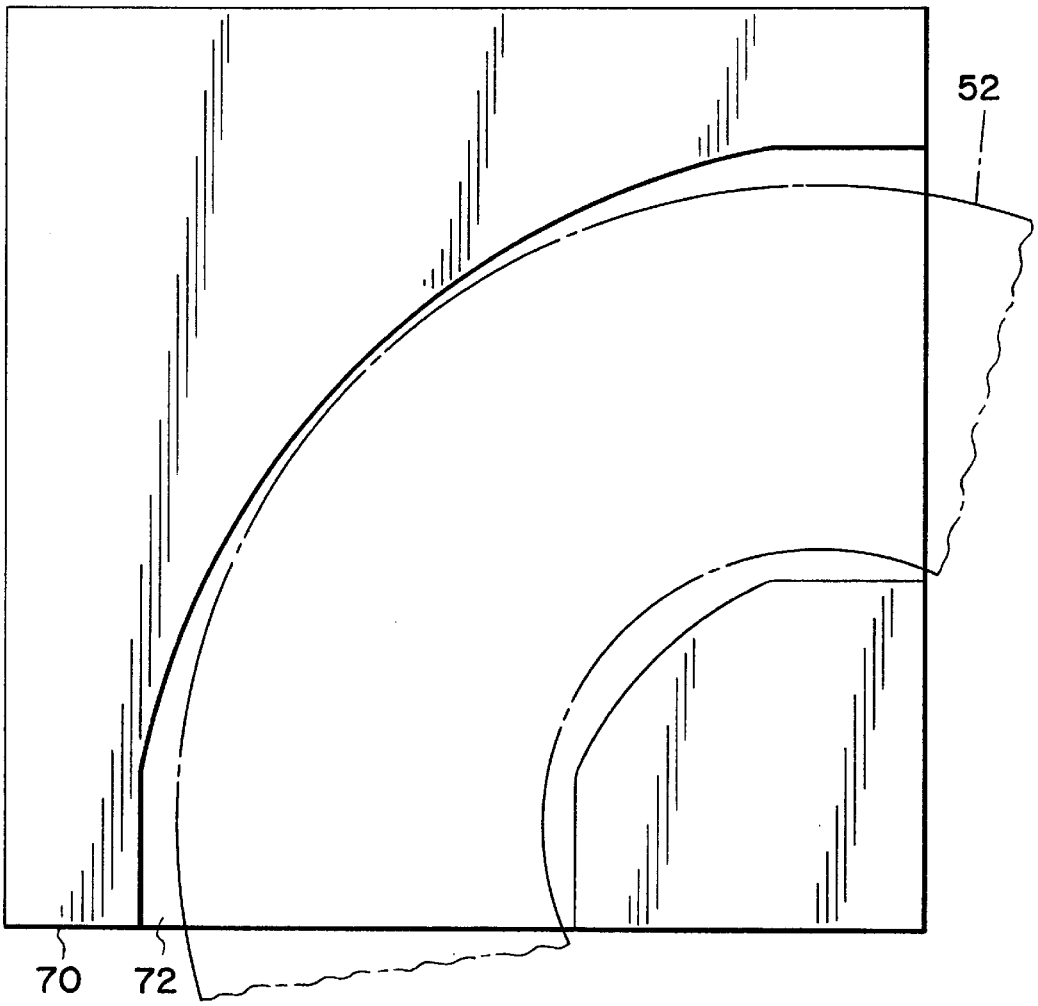
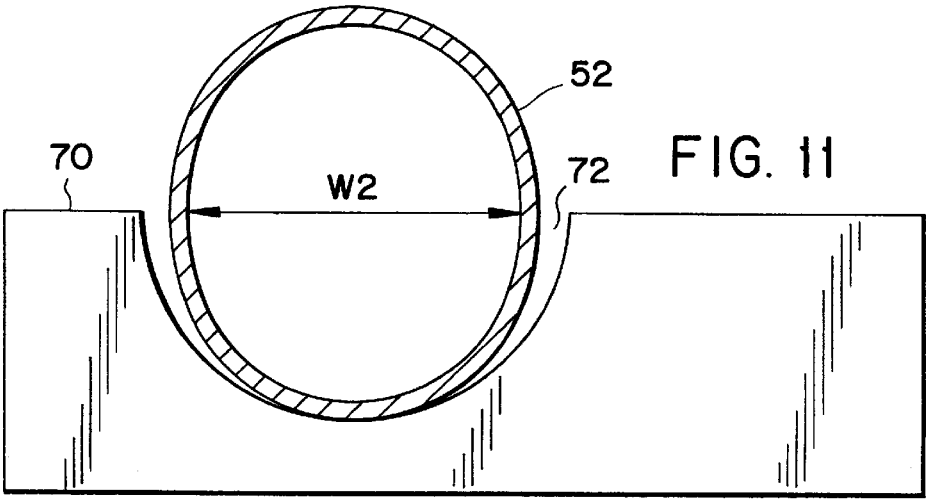
FIG. 11

METHOD AND APPARATUS FOR MAKING PIPE LINE STEEL GROOVED-END FITTINGS

The invention is directed to a method and an apparatus for manufacturing steel pipe line fittings. More particularly, the invention is directed to a method and apparatus for bending pipe to form pipe fittings for grooved-end joining systems.

BACKGROUND OF THE INVENTION

In grooved-end mechanical pipe joining systems, pipes and pipe fittings are joined by a collar that engages grooves in the ends of the pipes and pipe fittings. This type of mechanical joining system is commonly used, for example, in piping for automatic fire protection systems. FIG. 1 is a drawing of a pipe elbow 5 for grooved-end mechanical joining as may be formed by a casting process, as further described below. The pipe elbow 5 includes a central curved portion 6 that defines an elbow bend and tangential end portions, or tangents 7, 8, extending linearly from the ends of the curved portion 6. The tangents 7, 8 serve as the fastening joints. To fit in a system, the elbow 5 is formed within geometrical constraints including a specified distance S from the axial centerline of one tangent end to the end face of the opposite tangent end. In addition, a tangent axial length T and a diameter D of the elbow are chosen so that the elbow can mate with pipes in piping system.

The tangents 7, 8 are each provided with a circumferential groove 9, 10. In a connecting pipe, a groove is also provided. FIG. 2 shows in part section a cast elbow joint or fitting 11 attached to a grooved pipe end 12. When the fitting 11 is butted against the pipe 12, the groove 16 on the pipe elbow is parallel to the groove 18 on the pipe end. A fastening collar 14 engages the grooves 16, 18 in the abutting ends of the elbow and pipe to fasten the elbow 11 and pipe 12.

Referring again to FIG. 1, the inner radius R1 bend of the conventional pipe elbow 5 presents difficulties for manufacturing, particularly in light wall pipe as is used in fire protection systems. To form a smooth curve, the radius R1 is typically taken from a center of curvature C1 determined by the intersection of the inner margins 7*a*, 8*a* of the tangents 7, 8 as illustrated in FIG. 1. Bending the pipe to form the central curved portion does not form the tangents, however, which must be shaped in a separate step. When the pipe is further worked to form the tangents, for example in a die, the work typically creates unwanted distortion in the inner radius wall. If the radius is too small, buckling of the inner radius occurs. If the radius is too large, bulging occurs.

As a result of these problems, elbows fittings for grooved-end systems are usually produced as a casting or by welding together pipe segments to avoid the bending-related problems.

Casting techniques, however, are limited to forming parts that typically have a minimum wall thickness that exceeds the thickness of light-wall pipes used in fire protection systems. FIG. 2 illustrates a cast pipe fitting 11 connected to a light wall pipe 12, in which the difference in wall thickness between the fitting 11 and the pipe 12, and the resulting difference in internal diameters, may be seen. The change in flow passage area caused by a cast pipe fitting in a system adds flow resistance and pumping losses to the system, which increases the installation and operating costs of such systems.

A fabricated elbow fitting 20, shown in FIG. 3, is welded from straight pipe segments. The welded fitting 20 is formed with a groove 22 that is connected by a collar 14 to the pipe. Because of the shape transitions and irregular corners, a weld fabricated elbow introduces even greater flow restrictions and pumping losses in a pipe system than a cast fitting.

In addition, both casting and weld fabrication elbows are costly to produce, and add expense to the piping system.

SUMMARY OF THE INVENTION

The invention provides a method and an apparatus for forming steel grooved-end pipe elbows from short lengths of standard pipe. The invention is particularly advantageous for light weight pipe as is used in fire protection systems, but is not limited thereto, and may be used for other types of pipe as well.

According to the invention, the pipe elbows are formed from the same pipe stock as is used to construct the piping system itself, and thus, the outside and inside diameters and wall thickness of the fittings match those of the rest of the system. Problems relating to flow restriction in cast or weld fabricated elbows are thus eliminated.

The present invention provides, also, a method and apparatus in which a mandrel press forms a bend in a pipe section and a die further works the pipe section to form tangent end portions.

According to the invention, the method includes the steps of moving a segment of straight pipe over a shaping mandrel to form a curved pipe section with an oval cross-section and having a predetermined average radius of curvature. The longer diameter of the oval is perpendicular to the radius of curvature of the elbow and the shorter diameter of the oval is parallel to the radius of curvature.

According to another aspect of the invention, the pipe segment is heated while on the mandrel, by passing through a heating chamber, before the bending step.

The curved pipe section is placed in a die having a cavity shaped for a finished elbow fitting and compressed in the die, which includes a curved center portion and tangential end portions. The curved elbow expands under the pressure of the die to conform to the die cavity, to form a fitting having a circular cross-section and a curved central portion with tangential end portions.

According to the invention, the curved center portion of the die cavity has an average radius of curvature that is greater than the average radius of curvature of the curved pipe section.

According to another aspect of the invention, the tangents are trimmed to be mutually perpendicular and grooves are formed in the tangents. A groove forming apparatus includes a table to support the fitting on one tangent end face. The wall of the tangent is placed between an inner roller and an outer roller. A force is applied through the outer roller and the roller rotate the fitting so that the groove is formed about the circumference of the tangent.

The apparatus for forming the grooves includes a horizontal table for supporting a pipe fitting. On the table, a groove forming roller for applying a force on the pipe fitting to form a groove and a drive roller for rotating the pipe fitting are mounted. The rollers are spaced on said table to receive a wall of the pipe fitting in the space therebetween. The pipe fitting is place between the rollers, and a hydraulic force mechanism presses the groove forming roller against the fitting. A drive shaft rotates the drive roller to rotate the fitting to form the groove around the circumference of the fitting.

A retaining collar holds the pipe fitting on the table. The retaining collar includes a U-shaped arm with a plurality of retaining rollers, the rollers being mounted on the arm at an angle to apply a downward retaining force on a pipe fitting.

BRIEF DESCRIPTION OF THE DRAWINGS

The invention will be better understood by reference to the following description in conjunction with the appended drawings, in which:

FIG. 5 is a diagram of a pipe elbow in accordance with the invention;

FIG. 6 is a schematic diagram of part of an apparatus for forming the elbow of FIG. 5;

FIG. 7 is illustrates a forming head of a mandrel for the apparatus of FIG. 6;

FIG. 10 is a plan view of a die part for forming the pipe elbow of FIG. 6 from the curved pipe segment of FIG. 8 and FIG. 9;

FIG. 11 is an end view of the die part of FIG. 10;

DETAILED DESCRIPTION

FIG. 5 is a diagram of a pipe elbow fitting 30 in accordance with the invention which is formed from a section of standard pipe. The elbow 30 includes the curved central portion 32 and tangential end portions, or tangents, 34, 36, corresponding to those shown in the cast-formed elbow 5 of FIG. 1. The elbow 30 according to the invention is formed with an inner radius of curvature R3 defining the inner wall 32*b* and an outer radius R4 defining the outer wall 32*a*. As may be seen by comparing FIG. 1 to FIG. 6, the inner R3 and outer R4 radii are greater than the corresponding radii R1 and R2 of the conventional pipe elbow 5.

Figure 1:
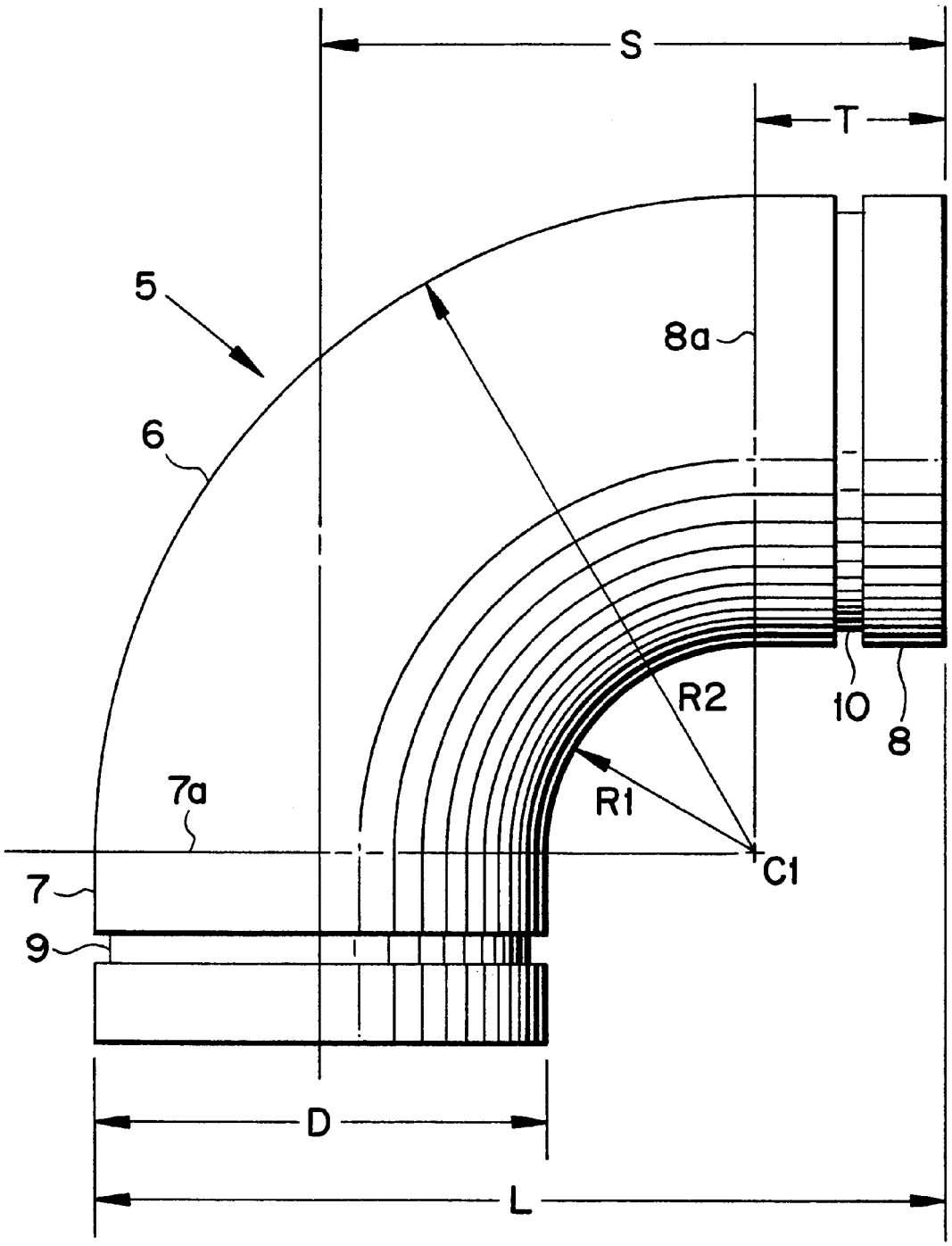
FIG. 1 (PRIOR ART)
FIG. 1 is a diagram of a pipe elbow fitting for a grooved-end joining system.
Figure 2:
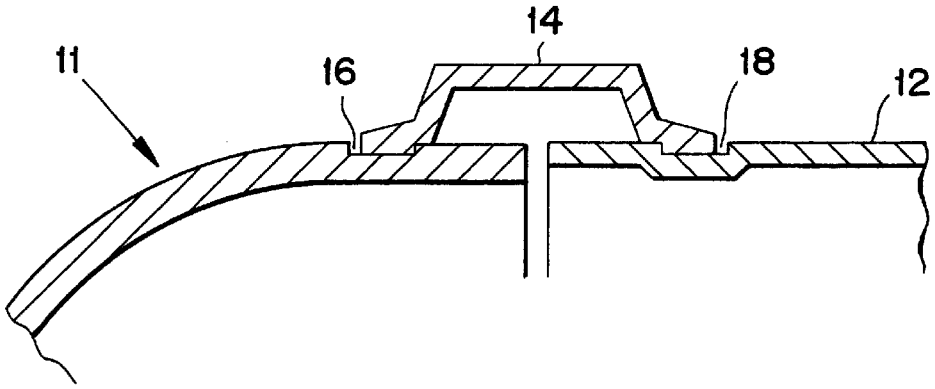
FIG. 2 (PRIOR ART)
FIG. 2 is a sectional view of cast elbow fitting joined to a pipe by a grooved-end fastener according to the prior art.
Figure 3:
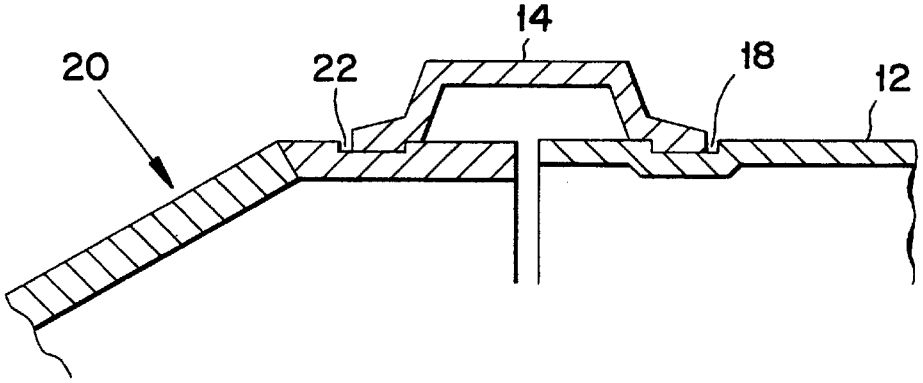
FIG. 3 (PRIOR ART)
FIG. 3 is a sectional view of a weld fabricated elbow joined to a pipe by a grooved-end fastener according to the prior art.

The shape of the pipe elbow 30 is designed to permit the use of a mandrel press for bending the pipe segment, followed by a die forming operation for making the tangents and a finished shape. The method thus replaces the casting or weld fabricating methods of the art, and eliminates the disadvantages relating to those methods and the elbows formed by those methods. The relative positions of the tangents 34, 36 correspond to the conventional geometry for a pipe elbow as shown in FIG. 1 so that the fitting according to the invention may fit in a grooved-end system. Accordingly, the pipe elbow 30 maintains the center-to-end distance S, has a tangent length T, and has the outer diameter D of the conventional pipe elbow 5 (which may be understood by comparing FIG. 6 to FIG. 1).

Figure 4:
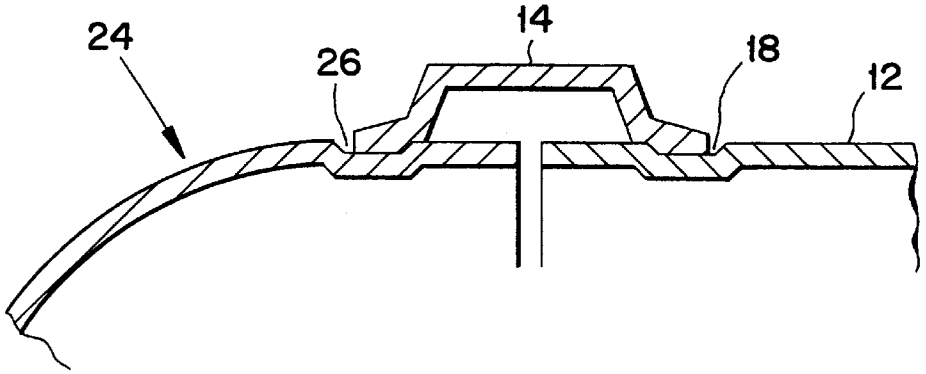
FIG. 4 is a sectional view of a pipe elbow fitting in accordance with the invention joined to a pipe by a grooved-end fastener.

As seen in FIG. 4, a fitting 24 according to the invention is joined to a pipe 12 without imposing the change in inside diameter or shape irregularities present in the cast 11 and weld fabricated 20 fittings of the prior art. The fitting in accordance with the invention thus more closely fits the piping of the system, and does not add flow losses because of the thickness of the walls.

To form the fitting 30, a plan for the overall shape including the required geometrical constraints (S, T and D) is laid out. The curved central portion 32 is then established by developing curves to connect the inner margins of the two tangents 34, 36. The inner radius R3, however, is calculated to avoid both the buckling and the bulging problems described above. The inner radius R3 is thus made greater than the radius R1 of the cast elbow 5. As may be understood from FIG. 1, the conventional inner radius R1 satisfies the equation $R1=S-(T+\frac{1}{2}D)$, which in terms of the illustration, has an origin at a point where lines extending from the inner margins 7*a*, 8*a* of the tangents intersect.

According to a preferred embodiment, as shown in FIG. 5, the radii R3 and R4 are conveniently developed as having a center of curvature at a point C2 where lines taken from the end faces 34*a* and 36*a* of the tangents 34, 36 intersect. In terms of the overall geometry of the fitting, the inner radius R3 and an outer radius R4 are preferably selected to satisfy the relationships $R4=((S+\frac{1}{2}D)^2+T^2)^{1/2}$ and $R3=R4-D$.

Figure 8:
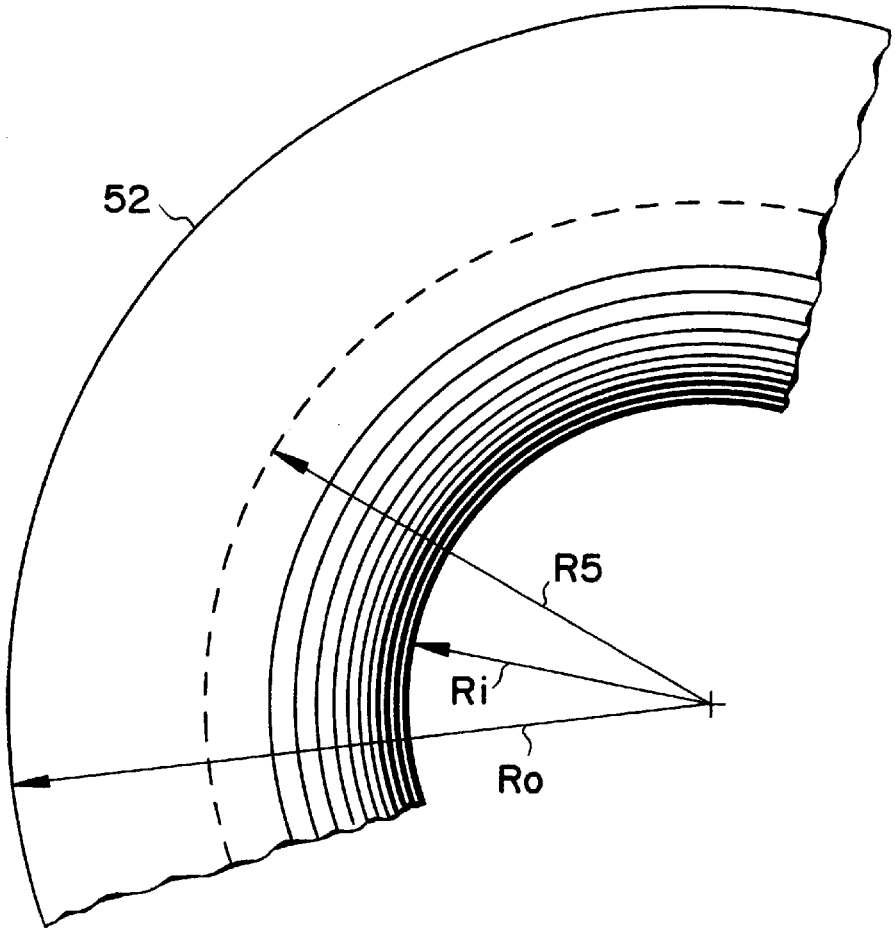
FIG. 8 is a plan view of a curved pipe segment formed by the apparatus of FIG. 6.

A method in accordance with the invention is described with reference to FIGS. 6–13. In FIG. 6, an apparatus for bending a segment of straight pipe is schematically illustrated. The apparatus includes a mandrel press having a forming mandrel 40 with an elongated first portion that widens from a narrow loading end 42 to a wider forming end 44, which terminates in a forming head 46. FIG. 7 illustrates a forming head 46 of the mandrel of FIG. 6. A plurality of straight pipe segments 50 are loaded on the loading end 42 and a ram 48 presses the pipe segments along the mandrel 40. The pipe segments 50 on the mandrel 40 pass through a heating chamber 60 where they are heated to facilitate bending and shaping on the forming head 46. The heated pipe segments are forced over a forming head 46, which produces a curved pipe segment 52 having a continuous curved shape with an average radius of curvature R5, as shown in FIG. 8.

Figure 9:
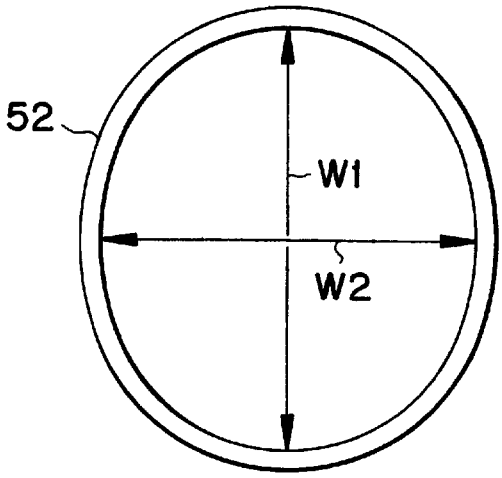
FIG. 9 is an end view of the curved pipe segment of FIG. 8.

The forming head 46 also gives the curved pipe segment an oval cross-section, shown in the end view of the curved pipe segment 52 in FIG. 9. Oval as used herein is meant to include cross-sectional shapes having a diameter that is longer in one direction than in a perpendicular direction, including elliptical or approximately elliptical shapes. The longer diameter W1 of the oval cross-section is perpendicular to a plane in which the pipe curvature lies.

The curved pipe segment 52 is then placed in a die 70 having a cavity 72 for forming the shape of the fitting 30 shown in FIG. 5. A mating die part (not shown) is positioned to enclose the curved pipe segment, and the die parts are forced together to compress the curved pipe segment 52. The die cavity 72 has a center curved portion and tangents, and with the mating die, defines a circular cross-section. The pipe segment 52 deforms under pressure to take on the shape of the cavity 72, wherein the pipe segment 52 is shaped as shown in FIG. 5. In deforming to the shape of the cavity 72, the cross-section of the pipe segment becomes circular, the tangents 34, 36 are formed, and the outer 32*a* and inner 32*b* walls of the curved portion 32 are shaped to have curvatures R3 and R4.

As may be understood from FIG. 10, the curved pipe segment 52 has an inner radius Ri and an outer radius Ro (indicated in FIG. 5) that are smaller than the inner radius R3 and outer radius R4 of the die cavity 72.

The average radius R5 for the curved pipe segment 52 is calculated so that the curved pipe segment 52 can fit in the die cavity 72 extending from end to end as shown in FIG. 10 for the die forming step. Preferably, the average radius R5 satisfies the equation R5=(R1+L)/2 where R1 is the curvature of the standard pipe fitting and satisfies the relationship R1=S−(T+½D), and wherein S is a distance measured from a center axis of one tangent to an end face of the opposite tangent, D is an outer diameter of a finished fitting, T is the axial length of the tangent, and L is an overall length of the fitting, L=D+R1+T.

In addition, the curved pipe segment has, as mentioned, an oval cross-section. The smaller diameter of the cross-section, which lies parallel to the plane of the radius of curvature R3, satisfies the equation W2=(R4−R3)×k where k is a constant within the range of about 0.80 to 0.95. This relationship allows the oval cross-section to deform to a circular shape of diameter R4−R3 in the die.

These relationships accordingly determine the shape of the forming head 46.

Once the curved pipe segment 52 is shaped in the die 70, the ends of the tangents are trimmed so that the end faces 34*a*, 36*a* of the tangents are mutually perpendicular. A pipe elbow 30 is thus formed as illustrated in FIG. 5.

Figure 12:
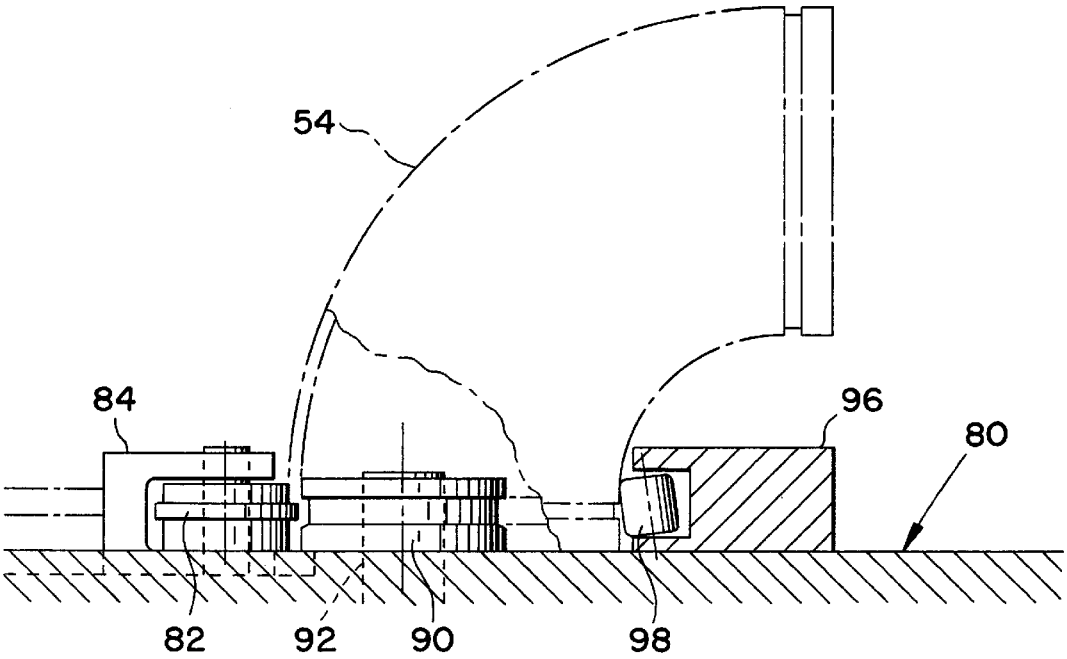
FIG. 12 is a side view of a roll groove forming apparatus.
Figure 13:
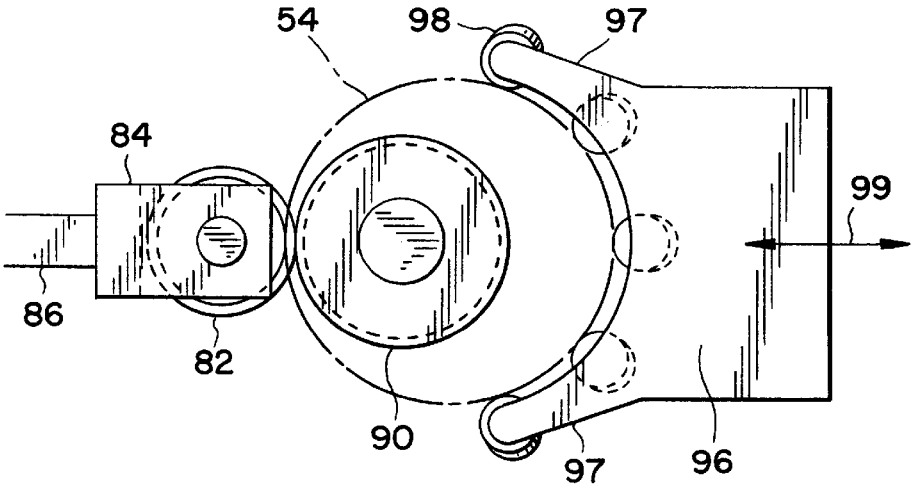
FIG. 13 is a top view of the apparatus of FIG. 12.

The pipe elbow 30 is then further worked to form the grooves for use in the grooved-end method of joining. Conventional roll forming devices have a roll forming mechanism on a side of the device so that a pipe can be supported horizontally adjacent to the device for rotation as the groove is formed. The elbow fitting 30 of FIG. 5 cannot be easily supported horizontally for rotation on a conventional device, however. The present invention therefore provides a device for roll forming the grooves in an elbow. FIG. 12 illustrates a side view of a table top groove forming device in accordance with the invention. FIG. 13 is a top view of the device of FIG. 12. A pipe fitting 54 is shown in broken lines in place on the device.

The groove forming device includes a horizontal supporting surface 80 or table. An exterior idling roller 82 is mounted on a carriage 84 which includes a hydraulic drive means 86 to apply a force for forming the groove. The hydraulic drive means 86 also controls the depth of the groove by establishing the distance at which the exterior roller 82 acts. An interior drive roller 90 is mounted on a motor driven shaft 92 to provide rotation of the elbow to form the groove circumferentially about the elbow. A retaining device 96 includes a plurality of rollers 98 mounted on a U-shaped arm and angled to apply a downward pressure on the elbow as it rotates. A force applying means 99 maintains the rollers 98 against the elbow 54.

As may be seen in FIGS. 12 and 13, an elbow 54 is placed on the device so that the wall of the tangent is positioned between the outside idling roller 82 and the inside drive roller 90. The retaining device 96 contacts the outside of the elbow 54 opposite to the idling roller 82 to maintain the elbow 54 on the table 80 in correct position.

As the elbow 54 is rotated by the driving roller 90, a groove is formed on the outer surface of the elbow at the tangent portion.

While particular embodiments of the present invention have been described and illustrated, it should be understood that the invention is not limited thereto since modifications may be made by persons skilled in the art. The present application contemplates any and all modifications that fall within the spirit and scope of the underlying invention disclosed and claimed herein.

I claim:

1. A system for making grooved-end pipeline elbow fittings from a straight length of pipe, comprising:

a mandrel press for forming a curved pipe segment to have an average radius R5 and an oval cross-section, wherein R5=(R1+L)/2, where R1 is a conventional inner radius for the fitting and L is an overall length of the fitting, and a shorter diameter Ws of the oval cross-section satisfies the relationship Ws=(R4−R3)×k, wherein k is a constant having a value less than 1.0;

a die for forming a fitting from the curved pipe segment, the die having a die cavity shaped with a central curved part and tangential end parts, the central curved part having an inner radius of curvature R3 according to a relationship $R3=((S-\frac{1}{2}D)^2+T^2)^{1/2}$ and an outer radius of curvature R4 according to a relationship $R4=((S+\frac{1}{2}D)^2+T^2)^{1/2}$, wherein S is a distance measured from a center axis of one tangential end portion to an end face of the opposite end portion, D is an outside diameter of the pipe segment, and T is an axial length of the tangential end portion; and means for forming grooves on tangential end portions of a fitting.

2. The system as claimed in claim 1, further comprising means for heating a pipe segment on the mandrel press.

3. The system as claimed in claim 2, wherein the mandrel press includes a mandrel having an elongated straight portion and a curved forming head, and the heating means is disposed to heat a pipe segment on the straight portion.

4. The system as claimed in claim 1, wherein the constant k has a value in a range of about 0.80 to 0.95.

5. The apparatus as claimed in claim 1, wherein said means for forming a groove comprises:

a horizontal table for supporting the pipe fitting standing on an open end of a tangent, a groove forming roller for applying a force on the pipe fitting to form a groove and a drive roller for rotating the pipe fitting, said rollers mounted on said table to receive a wall of the pipe fitting therebetween, and a retaining collar to hold the pipe fitting on the table.

6. The system as claimed in claim 5, wherein the retaining collar includes a U-shaped arm with a plurality of rollers, the rollers mounted on the arm at an angle to apply a downward retaining force on a pipe fitting.

7. The system as claimed in claim 1, wherein R1=S−(T+½D) and L=S+½D.

8. An apparatus for making grooved-end pipeline elbow fittings from a curved pipe segment having an average radius R5 and an oval cross-section, wherein R5=(R1+L)/2, where R1 is a conventional inner radius for the fitting and L is an overall length of the fitting, and a shorter diameter Ws of the oval cross-section satisfies the relationship Ws=(R4−R3) x k, wherein k is a constant having a value less than 1.0, the apparatus comprising:

a die for forming a fitting from said curved pipe segment, the die having a die cavity shaped with a central curved part and tangential end parts, the central curved part having an inner radius of curvature R3 according to a relationship $R3=((S-\frac{1}{2}D)^2+T^2)^{1/2}$ and an outer radius of curvature R4 according to a relationship $R4=((S+\frac{1}{2}D)^2+T^2)^{1/2}$, wherein S is a distance measured from a center axis of one tangential end portion to an end face of the opposite end portion, D is an outside diameter of the pipe segment, and T is an axial length of the tangential end portion.

* * * * *